United States Patent [19]

Dunphy et al.

[11] Patent Number: 4,689,975

[45] Date of Patent: Sep. 1, 1987

[54] PADLOCK

[75] Inventors: Gerald F. Dunphy, Glen Waverley; Donald J. Newman, Sommerville, both of Australia

[73] Assignee: Ogden Industries Pty. Ltd., Huntingdale, Australia

[21] Appl. No.: 902,597

[22] Filed: Aug. 5, 1986

[30] Foreign Application Priority Data

Aug. 15, 1985 [AU] Australia ..... PH 1959

[51] Int. Cl.[4] ..... E05B 67/38

[52] U.S. Cl. ..... 70/56; 70/52

[58] Field of Search ..... 70/2, 6, 52, 54, 55, 70/56; 292/181

[56] References Cited

U.S. PATENT DOCUMENTS 3,858,923 1/1975 Bunn ..... 70/52

4,238,941 12/1980 Halopoff ..... 70/56

*Primary Examiner*—Robert L. Wolfe

*Attorney, Agent, or Firm*—Berman, Aisenberg & Platt

[57] ABSTRACT

A padlock of the kind having a body and a U-shaped shackle which projects above an upper end surface of the body. The shackle has a captured leg which is retained against separation from the body but which can move relative to the body to allow the shackle to adopt a locked or a released condition. Another leg of the shackle has an end portion which is located within the body and is clear of the body respectively in the locked and released conditions of the padlock. A shroud is formed integral with the body and extends upwards from the body upper end surface so as to completely protect the front of the shackle under both the locked and released conditions. The shroud has a rearwardly opening cavity which substantially contains the shackle when in the locked condition so that the shackle is exposed only at the rear of the padlock. The rear of the padlock is substantially flat, whereas the front has a convex curvature.

10 Claims, 13 Drawing Figures

PADLOCK

Figure 1:
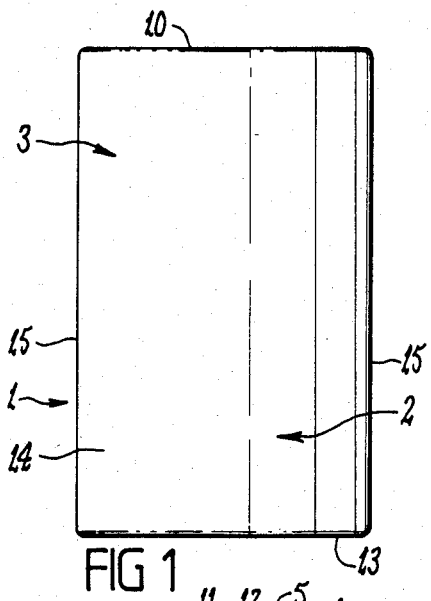

This invention relates to padlocks and is particularly concerned with the security of such devices. The invention is applicable to padlocks having any type of locking mechanism, but it will be convenient to hereinafter describe the invention with particular reference to a padlock of the kind having a key releasable locking mechanism of the pin-tumbler type.

Padlocks generally comprise a body and a U-shape shackle which extends from one side or end of the body and is movable relative to the body between locked and released conditions. In the locked condition both legs of the shackle are captured within the body, whereas in the released condition one leg is clear of the body and can be swung laterally about the longitudinal axis of the other.

In many padlocks the shackle extends beyond a side or end surface of the padlock body so as to be fully exposed apart from those sections of the shackle which are contained within the body. It is therefore an easy task to destroy the locking effect of the padlock by attacking the shackle with any of a variety of tools such as bolt cutters, hacksaws, rod saws, and cam operated devices which force the shackle out of the padlock body. There are other methods of breaking or forcing the shackle which are adopted because of the exposed nature of the shackle.

Various attempts have been made to overcome the weakness referred to above. One such attempt involves substitution of hardened bars for the standard round section shackle, but those bars have not been immune from attack by special saws and their shape is such as to restrict the circumstances in which the padlock can be used. Another approach has been to extend a part or parts of the padlock bodies so as to provide a partial shroud for the shackle and thereby protect it from attack, but such padlocks have not been entirely satisfactory in practice.

Padlocks are commonly used with hasps having a hinged plate or bar and a curved staple which projects through an aperture in the hinged plate when the hasp is closed and is adapted to receive the padlock shackle. Shrouded padlocks are generally not suited for use with standard hasps because the shroud tends to foul with the staple and/or plate such as to cause the padlock to sit out at an angle rather than flat against the surface over which the hasp extends. A padlock positioned in that way is susceptible to attack thereby negating the benefit of the shroud. It has therefore been the practice to design special hasps for use with shrouded padlocks and that has added to the cost and inconvenience of using such padlocks.

It is an object of the present invention to provide a shrouded-type padlock which is secure in use and can be used with standard hasps.

A padlock according to the invention is characterised in that the shroud of the padlock body is so arranged that it substantially covers the shackle when the padlock is in the locked condition. In particular, the shackle does not protrude significantly beyond the top of the shroud, but the reverse preferably applies.

According to one aspect of the invention, there is provided a padlock including, a body, a U-shaped shackle projecting beyond an upper end surface of said body and being movable relative to said body between locked and released conditions at which said projection is least and greatest respectively, said shackle having two parallel legs one of which is captured within said body against escape at all times and the other of which is located within and outside said body in said locked and released conditions respectively, locking mechanism within said body which is operable to engage said other leg to releasably hold said shackle against movement from the locked to the released condition, a shroud formed integral with said body and extending beyond said upper end surface by a distance at least substantially equal to said greatest projection of the shackle, and a cavity in a rear side of said shroud which substantially contains the portion of said shackle which is exposed beyond said upper end surface when the shackle is in the locked condition.

It is preferred that the rear side of the padlock is substantially flat and that the front side has a convex curvature. It is also preferred that the front side of the shroud forms a continuation of the front side of the padlock body.

The cavity for receiving the locked shackle can be of any suitable form, but is preferably arranged so that the shackle legs are closely confined within the cavity. That may be achieved by forming two grooves in the rearwardly facing surface of the cavity and arranging each groove so that it receives part of a respective shackle leg and has a transverse cross-sectional shape which is substantially complementary to that of the received part of the leg. A recess may be provided between those grooves for receiving part of a staple to which the padlock is attached when in use.

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 2:
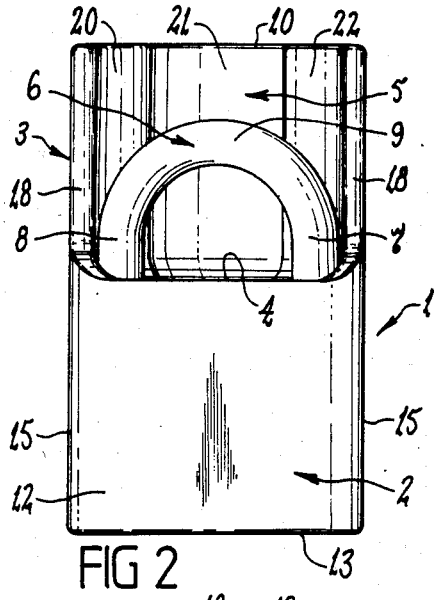
Figure 3:
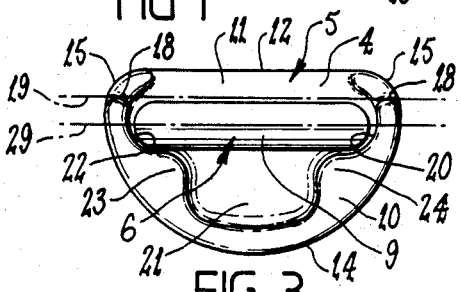
Figure 4:
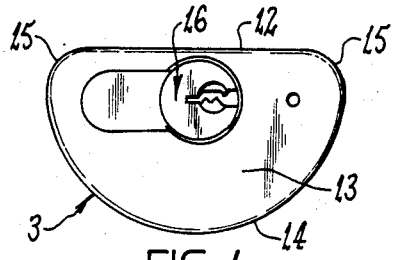
Figure 5:
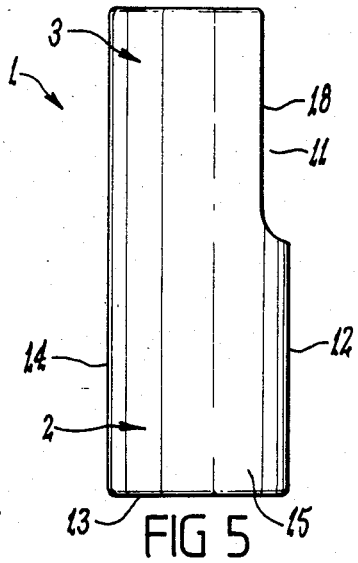
Figure 6:
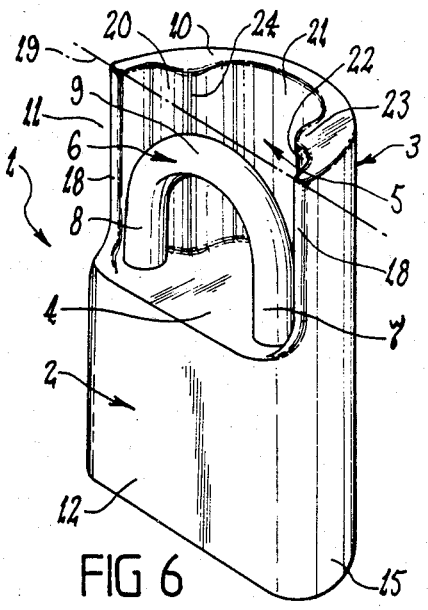
Figure 8:
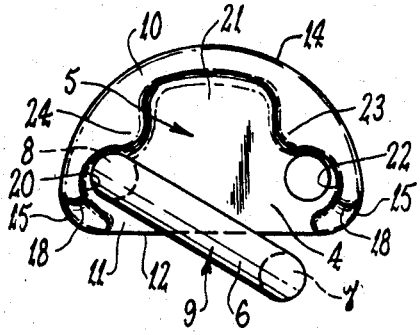
Figure 7:
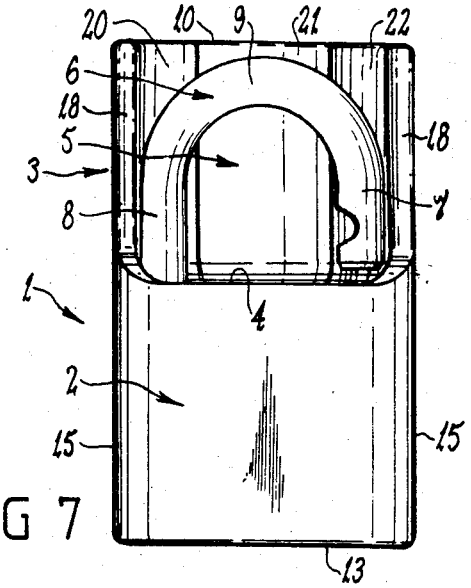
Figure 11:
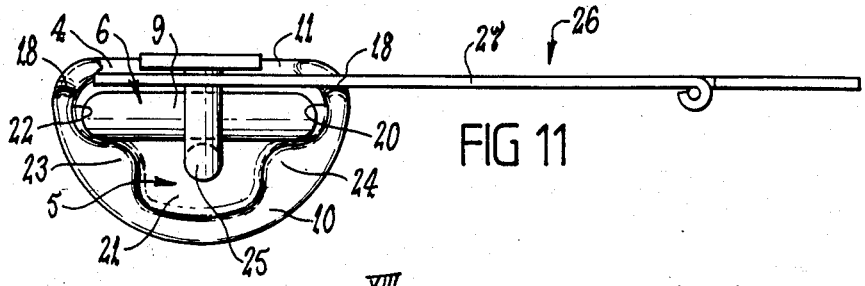
Figure 12:
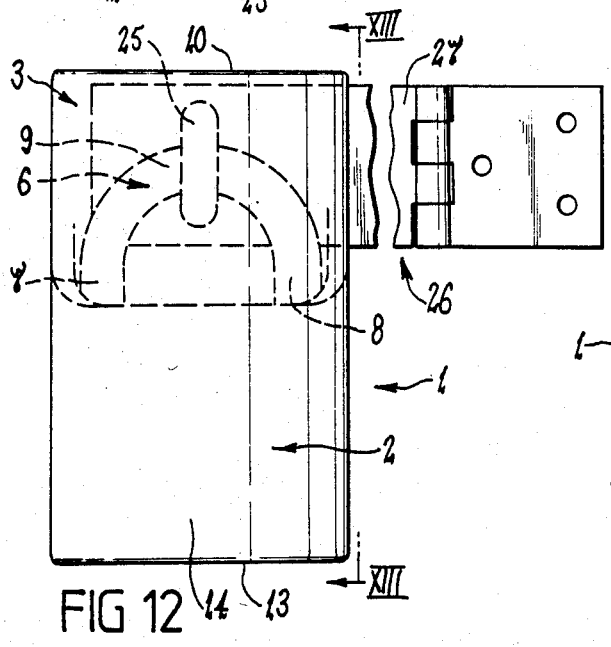
Figure 13:
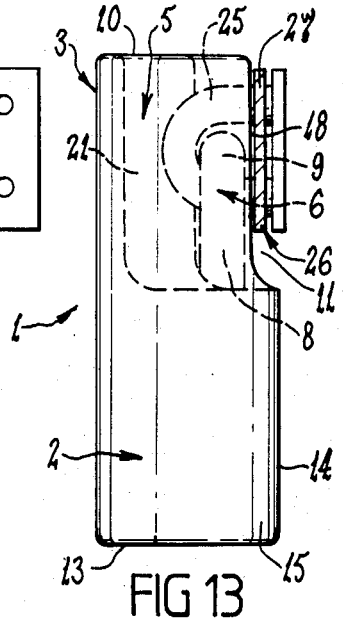
Figure 9:
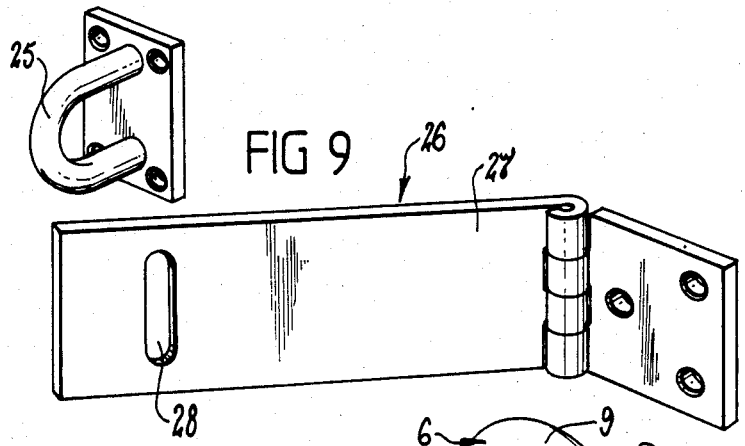
Figure 10:
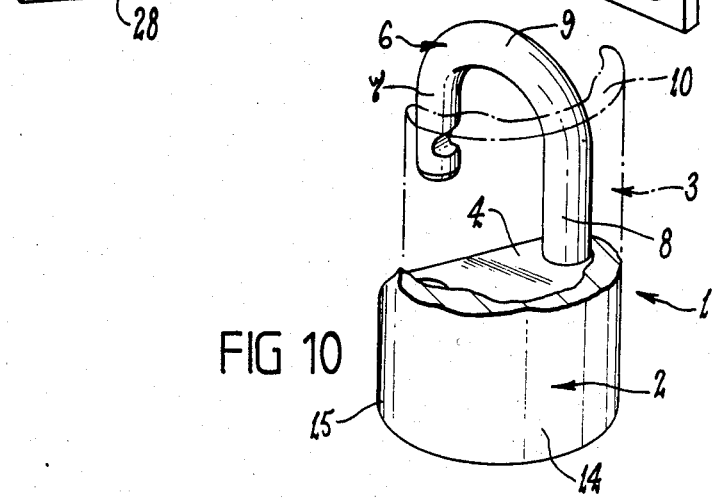

In the drawings:

FIG. 1 is a front elevational view of one form of padlock according to the invention, FIG. 2 is a rear elevational view of the padlock shown in FIG. 1, FIG. 3 is a top plan view of the padlock shown in FIG. 1, FIG. 4 is a bottom plan view of the padlock shown in FIG. 1, FIG. 5 is a side elevational view of the padlock shown in FIG. 1, FIG. 6 is a rear perspective view of the padlock shown in FIG. 1, FIG. 7 is a view similar to FIG. 2 but showing the padlock in the released condition, FIG. 8 is a view similar to FIG. 3 but showing the released shackle pivoted relative to the padlock body, FIG. 9 is a perspective view of a hasp to which the padlock of the invention can be connected, FIG. 10 is a front perspective view of a padlock according to the invention, with part broken away for convenience of illustration, conditioned for attachment to the hasp of FIG. 9, FIG. 11 is a view similar to FIG. 3 but showing the padlock attached to a hasp as shown in FIG. 9, FIG. 12 is a front elevational view of the assembly shown in FIG. 11, FIG. 13 is a cross-sectional view taken along line XIII—XIII of FIG. 12.

The padlock 1 shown in the attached drawings includes a body 2 and a shroud 3 which is formed integral with the body 2 and projects upwardly from an upper end surface 4 of the body 2 (FIGS. 2 and 6). The shroud 3 of the construction shown is in the form of a wall which is so contoured as to define a rearwardly opening cavity 5 which substantially contains the lock shackle 6 when that shackle 6 is in the locked condition as shown in FIGS. 2, 3 and 6. In accordance with usual practice, the particular shackle 6 shown includes two parallel and straight legs 7 and 8 connected at one end through a curved bight portion 9. Also as shown, the shackle 6 projects upwardly from the body end surface 4 and is movable relative to the body 2 so as to have minimum projection in the locked condition (FIG. 2) and maximum projection in the released condition (FIG. 7).

In the preferred form shown, the cavity 5 is open at the top 10 and at the rear side 11 (FIG. 5) only. The top 10 of the shroud 3 is remote from the padlock body 2 and the open side 11 is substantially coincident with a surface 12 of the padlock body 2 which in use becomes the rear surface of the padlock 1. In that regard, the padlock body 2 as shown has substantially flat upper and lower ends 4 and 13 respectively, relatively broad front and rear surfaces 14 and 12 respectively, and relatively narrow sides 15. It is preferred that the rear surface 12 is substantially flat as shown, whereas the sides 15 and the front surface 14 are curved so that the transverse cross-sectional shape of the body 2 has the appearance of an oval with a flat along one broad side.

The shackle 6 as shown is of conventional form and may cooperate with the padlock body 2 and associated locking mechanism 16 (FIG. 4) in a conventional manner. In the construction shown, the shackle 6 is U-shaped and formed of round bar and has one leg 8 captured within the padlock body 2 and the other leg 7 is arranged for releasable engagement by the locking mechanism 16, which is preferably key operated. The captured leg 8 is rotatably mounted on the body 2 and is capable of limited axial movement between the locked and released condition (FIGS. 2 and 7 respectively), as in prior padlocks. When in the released condition, the shackle 6 can be rotated about the axis of the leg 8 as shown in FIG. 8.

As in prior constructions, the shackle 6 projects from the upper end 4 of the padlock body 2 and the extent of that projection is at a minimum when the shackle 6 is in the locked condition (FIG. 2). In that condition each leg 7 and 8 of the shackle 6 is adjacent a respective side 15 of the padlock body 2.

The shroud 3 also extends upwards from the body upper end 4 and has a height such as to project beyond the shackle 6 when the shackle 6 is in the locked condition and to substantially protect the shackle 6 from the front when it is in the released condition (FIG. 7). That is, the shackle 6 should not project beyond the shroud top 10 when in the released condition, or if it does the projection should not be significant. The shrould 3 extends across the padlock body 2 so as to prevent access to the shackle 6 from the front and sides of the body 2 as shown by FIGS. 2, 3, 5 and 6.

For the foregoing purpose the shroud 3 comprises a wall which has an outer surface 17 substantially coincident with the front surface 14 and sides 15 of the padlock body 2. The shroud wall 3 need not extend for the full extent of each side 15 of the body 2 but the ends 18 of the shroud 3 are preferably located in a plane 19 (FIG. 3) which is substantially parallel to the body rear surface 12 and is positioned between the surface 12 and a plane 29 (FIG. 3) which passes through the axis of each shackle leg 7 and 8 when the shackle 6 is in the locked condition.

In the preferred arrangement shown, the inner surface of the shroud wall 3 is contoured so that the opposite end portions thereof are each positioned close to a respective one of the shackle legs 7 and 8 when the shackle 6 is in the locked condition. As shown, each such end portion extends in close relationship across the back and one side of the respective adjacent shackle leg 7 or 8 so that in the operative condition of the padlock 1, access to the shackle 6 is restricted to openings at the top and back of the shroud 3.

The foregoing effect is achieved in the construction shown by arranging the inner surface of the shroud 3 so that it is compsed of three grooves 20, 21 and 22 (FIG. 6) which extend substantially in the axial direction of the shackle legs 7 and 8. Each of the two outermost grooves 20 and 22 is arranged to receive part of a respective shackle leg 7 or 8 as shown in FIG. 3 and has a transverse cross-sectional shape which is substantially complementary to that of the received part of the respective shackle leg 7 or 8. Each leg 7 and 8 therefore nests within a respective groove 20 or 22 to achieve the close relationship previously referred to. The central groove 21 is separated from the outer grooves 20 and 22 by ribs 23 and 24 and is arranged to receive part of a staple 25 as shown in FIG. 11.

FIG. 9 shows a typical hasp 26 to which a padlock 1 as described can be attached. The hasp 26 includes a hinged plate 27 having an aperture 28 through an outer end portion, and a curved staple 26 which is adapted to be passed through the aperature 28 as shown in FIG. 11. FIG. 10 shows the padlock 1 in a condition such that the shackle 6 can be looped through the staple 25 to achieve the situation shown by FIGS. 11 to 13.

The padlock is so arranged that it is able to sit flat against the hasp plate 27 as shown by FIGS. 11 to 13. In addition, upward and outward tilting of the padlock body 2 is restricted by the upper end corners of the shroud wall 3 fouling against the adjacent surface of the hasp plate 27. It is therefore difficult to introduce a cutting instrument or other tool behind the shroud 3 so as to sever the shackle 6 or staple 26 or otherwise force the padlock 1. In that regard, it is significant that the staple 25 is at least substantially contained behind the shroud 3.

It will be apparent from the foregoing that a padlock as described has several advantages over the prior art including its ability to be used with standard hasps. The transverse cross-sectional shape of the padlock body contributes towards achievement of those advantages in that it provides a substantial depth of padlock forward of the shackle. That same result could be achieved of course by appropriate shaping of the shroud without corresponding shaping of the entire padlock body.

Various alterations, modifications and/or additions may be introduced into the constructions and arrangements of parts previously described without departing from the spirit or ambit of the invention as defined by the appended claims.

HAVING NOW described our invention, what we claim as new and desire to secure by Letters Patent is:

1. A padlock comprising, a body, a U-shaped shackle having a portion which projects beyond an upper end surface of said body, said shackle being movable relative to said body between a locked condition and a released condition at which said shackle portion projects beyond said upper end surface by a minimum extent and a maximum extent respectively, said shackle having two parallel legs one of which is captured within said body against escape at all times and the other of which is located within and outside said body in locked and released conditions respectively, locking means within said body operable to engage said other leg to releasably hold said shackle against movement from the locked to the released condition, a shroud integral with said body and extending beyond said upper end surface by a distance greater than said minimum extent of said shackle portion, said shroud extending completely across a front side of said body, two spaced end portions of said shroud extending towards a rear side of said body, each of said end portion at least partially overlapping a respective one of said shackle legs when said shackle is in said locked condition, said shroud forming a cavity in a rear side of said shroud between said end portions for substantially containing said shackle portion when the shackle is in said locked condition, said end portions forming an opening to allow said other shackle leg to move laterally relative to said shroud when the shackle is in said released condition so as to be thereby movable into and out of said cavity.

2. A padlock according to claim 1, wherein said body has a rear side which is substantially flat and which is substantially coincident with the rear side of the shroud.

3. A padlock according to claim 2, wherein the front side surface of the shroud forms a continuation of the front side surface of said body.

4. A padlock according to claim 1, wherein the rearwardly facing surface of said cavity has two laterally spaced and parallel grooves formed therein which extend in the longitudinal direction of said shackle legs, and each said groove has a concave curvature in transverse cross-section and is arranged to neatly contain part of a respective said leg when the shackle is in the locked condition.

5. A padlock according to claim 4, wherein a recess is formed in said rearwardly facing surface for receiving part of a staple to which said shackle is attached when the padlock is in use.

6. A padlock including a body having front and rear sides, a U-shaped shackle which projects upwardly from an upper end surface of said body and is movable relative to that body between locked and released conditions, said shackle having two parallel legs one of which is captured against separation from said body under both said conditions, the other said leg has an end portion which is located within said body in said locked condition and is located clear of said upper end surface in said released condition as a consequence of said relative movement, the projection of said shackle at its upper end surface being at its greatest when the shackle is in the released condition, locking means for preventing movement of said shackle from the locked to the released condition, and a shroud integral with said body and extending upwardly from said upper end surface, said shroud comprising a wall which extends completely across the front of the shackle when in either said locked or released condition and including a rearwardly opening cavity which, when the shackle is in the locked condition, substantially contains that part of the shackle which projects beyond said upper end surface, said cavity being composed of three sections, a central one of said sections being adapted to receive part of a staple to which said shackle is attached when the padlock is in use, and each of the other two sections receiving part of a respective said shackle leg when the shackle is in the locked condition so that said wall extends across and protects the outwardly facing side of each leg which is remote from the other said leg.

7. A padlock according to claim 6, wherein each of said other two sections forms a groove which has a transverse cross-sectional shape substantially complementary to that of the said received leg part and which extends substantially in the longitudinal direction of the respective said leg.

8. A padlock according to claim 6, wherein the rear side of said body is substantially flat, said shroud wall has two ends each of which is located adjacent said body rear side and is located in a plane which is substantially parallel to that rear side, and at least a substantial part of each said shackle leg is located on the side of said plane which is remote from the body rear side when the shackle is in the locked condition.

9. A padlock according to claim 6, wherein the front side surface of said body has a convex curvature so that the body has a maximum front to back depth along a line which is located between and extends substantially parallel to the shackle legs when the shackle is in the locked condition, and said shroud wall has a front side surface which forms a continuation of the said body front side surface.

10. A padlock according to claim 6, which has a rectangular shape when viewed from the front, and in which there is no step formed between the body and shroud wall except at the rear side of said padlock.

* * * * *